US006738033B1

(12) United States Patent
Hibino et al.

(10) Patent No.: US 6,738,033 B1
(45) Date of Patent: May 18, 2004

(54) HIGH RESOLUTION AND HIGH LUMINANCE PLASMA DISPLAY PANEL AND DRIVE METHOD FOR THE SAME

(75) Inventors: Junichi Hibino, Neyagawa (JP); Hidetaka Higashino, Kyoto (JP); Nobuaki Nagao, Uji (JP); Masaru Sekizawa, Ibaragi (JP); Kanako Miyashita, Moriguchi (JP); Masafumi Ookawa, Neyagawa (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/831,466

(22) PCT Filed: Nov. 8, 1999

(86) PCT No.: PCT/JP99/06192

§ 371 (c)(1),
(2), (4) Date: May 9, 2001

(87) PCT Pub. No.: WO00/30065

PCT Pub. Date: May 25, 2000

(30) Foreign Application Priority Data

Nov. 13, 1998 (JP) ..... 10-324074

(51) Int. Cl.[7] ..... G09G 3/28

(52) U.S. Cl. ..... 345/60; 345/62; 345/63; 345/66; 345/67; 345/68; 345/204; 345/208; 315/169.4

(58) Field of Search ..... 345/60, 62, 63, 345/66, 67, 68, 204, 208; 315/169.4

(56) References Cited

U.S. PATENT DOCUMENTS 5,656,893 A 8/1997 Shino et al.
5,745,086 A 4/1998 Weber
5,877,734 A 3/1999 Amemiya
6,184,848 B1 * 2/2001 Weber ..... 345/60
6,340,866 B1 * 1/2002 Yoo ..... 315/169.3
6,353,287 B1 * 3/2002 Sasaki et al. ..... 313/582
6,428,377 B1 * 8/2002 Choi ..... 445/24

FOREIGN PATENT DOCUMENTS

EP 657861 6/1995
EP 863534 9/1998

* cited by examiner

*Primary Examiner*—Bipin Shalwala
*Assistant Examiner*—Vincent E. Kovalick

(57) ABSTRACT

When a gas discharge panel is driven, a voltage is applied between scan and address electrode groups to perform set-up. The voltage waveform has four intervals. In a first interval, the voltage is raised in a short time (less than 10 μs) to a first voltage, wherein 100 V≦first voltage<starting voltage. Then, in a second interval, the voltage is raised to a second voltage no less than the starting voltage and with an absolute gradient smaller than that for the voltage rise in the first interval (no more than 9 V/μs). Next, in a third interval, the voltage is lowered in a short time (no more than 10 μs) from the second voltage to a third voltage no more than the starting voltage. Following this, in a fourth interval, the voltage is lowered still further (for 100 μs to 250 μs) with a gradient smaller than that for the voltage fall in the third interval. The time occupied by the whole voltage waveform should be no more than 360 μs. This means that a wall charge can be properly accumulated, allowing stable addressing to be performed even when the pulse applied during the address period is short (no more than 1.5 μs). This lengthens the discharge sustain period and improves luminance.

22 Claims, 14 Drawing Sheets

(a)

(b)

(a)

(b)

HIGH RESOLUTION AND HIGH LUMINANCE PLASMA DISPLAY PANEL AND DRIVE METHOD FOR THE SAME

TECHNICAL FIELD

The present invention relates to a gas discharge panel display apparatus such as a plasma display panel and a drive method for the same, used in computers, televisions and the like.

RELATED ART

Recently, rising demand for the production of a high-quality large-screen television such as is required for high-definition television (HDTV) has led to the development of display panels aiming to fill this gap in various technological fields, including cathode ray tubes (CRTs), liquid crystal displays (LCDs) and plasma display panels (PDPs).

CRTs are in widespread use as television displays, and demonstrate excellent resolution and image quality. However, the depth and weight of CRTs increase with screen size, making them unsuited for large-screens of 40 inches or more. LCDs, meanwhile, have low power consumption and a low drive voltage, but the manufacture of a large-screen LCD is technically difficult.

Projection displays use a complicated optical system, requiring precise adjustment of the optical axis, which raises manufacturing costs. The optical system is also susceptible to optical distortion, causing a dramatic deterioration in picture quality and a worsening in spatial frequency resolution characteristics. Such problems make projection displays unsuitable as high-resolution displays.

In the case of PDPs however, large flat-panel screens can be realized, and products in the 50-inch range are already being developed.

PDPs can be broadly divided into two types: direct current (DC) and alternating current (AC). AC PDPs are suitable for large-screen use and so are at present the dominant type.

In a conventional AC PDP, a front substrate and a back substrate are placed in parallel with barrier ribs sandwiched between them. A discharge gas is enclosed in discharge spaces divided by the barrier ribs. Scan electrodes and sustain electrodes are placed in parallel on the front substrate, and covered by a dielectric layer of lead glass. Address electrodes, barrier ribs and a phosphor layer, formed of red, green and blue phosphors excited by ultraviolet light, are arranged on the back substrate.

To drive a PDP, a drive circuit applies pulses to electrodes to cause discharge to occur in the discharge gas which emits ultraviolet light. Phosphor particles (red, green and blue) in the phosphor layer receive the ultraviolet light and are excited, emitting visible light.

However, discharge cells in this kind of PDP are fundamentally only capable of two display states, ON and OFF. Thus, an address-display-period-separated (ADS) sub-field drive method in which one field is separated into a plurality of sub-fields and the ON and OFF states in each sub-field are combined to express a gray scale is performed for each of the colors red, green and blue.

Each sub-field is composed of a set-up period, an address period, and a discharge sustain period. In the set-up period, set-up is performed by applying pulse voltages to all of the scan electrodes. In the address period, pulse voltages are applied to selected address electrodes while pulse voltages are applied sequentially to the scan electrodes. This causes a wall charge to accumulate in the cells to be lit. In the discharge sustain period, pulse voltages are applied to the scan electrodes and the sustain electrodes, generating discharge. This sequence of operations causing an image to be displayed on the PDP is the ADS sub-field drive method.

The NTSC (National Television System Committee) standard for television images stipulates a rate of 60 field-images per second, so the time for one field is set at 16.7 ms.

Means for Resolving the Above Problems

Currently, PDPs used for televisions in the 40–42-inch range conforming to the NTSC standard (640×480 pixels, a cell pitch of 0.43 mm×1.29 mm, and individual cell area of 0.55 $mm^2$) can achieve a panel efficiency of 1.2 lm/W and screen luminance of 400 $cd/m^2$, as described in FLAT-PANEL DISPLAY 1997, part 5~1, p. 198. However, even higher luminance is desirable.

HDTV having a high resolution of up to 1920×1080 pixels is currently being introduced. It is therefore desirable for PDPs, as it is for other types of display panel, to be able to realize this kind of high-resolution display.

However, high-resolution PDPs have a large number of scan electrodes, producing a corresponding increase in the length of the address period. Here, if the length of each field and the time required for set-up in each case are uniform, an increase in the length of the address period limits the proportion of each field occupied by the discharge sustain period to a lower level.

The proportion of each field occupied by the discharge sustain period is accordingly reduced in higher-resolution PDPs. The panel luminance of a PDP is proportional to the relative length of the discharge sustain period, so that increases in resolution tend to reduce panel luminance.

Therefore, the necessity of improving panel luminance when realizing a high-resolution PDP becomes still higher.

Various techniques are utilized in the art to attempt to resolve these difficulties. These include a technique for increasing the luminous efficiency of cells, improving overall panel luminance, by a method for improving the luminous efficiency of the phosphor layer, and a technique for performing scanning during the address period using a dual scanning method so that the same number of scan lines can be covered in approximately half the time.

These techniques have had some effect in overcoming the above problems, but do not provide a satisfactory response to the demands of a PDP having both high-resolution and high luminance. Therefore, other techniques should ideally be used in combination with these techniques to solve the problem.

DISCLOSURE OF INVENTION

The object of the present invention is to provide a gas discharge panel display apparatus and a gas discharge panel drive method capable of realizing a high-resolution construction along with high luminance.

To achieve this object, a voltage is applied between scan and address electrode groups to perform set-up when a gas discharge panel is driven. The voltage waveform has four intervals. In a first interval, the voltage is raised in a short time (less than 10 $\mu$s) to a first voltage, wherein 100 V≦first voltage<starting voltage. Then, in a second interval, the voltage is raised to a second voltage no less than the starting voltage and with an absolute gradient smaller than that for the voltage rise in the first interval (no more than 9 V/$\mu$s). Next, in a third interval, the voltage is lowered in a short time (no more than 10 $\mu$s) from the second voltage to a third voltage no more than the starting voltage. Following this, in a fourth interval, the voltage is lowered still further (for 100

μs to 250 μs) with a gradient smaller than that for the voltage fall in the third interval. The time occupied by the whole voltage waveform should be no more than 360 μs.

If this kind of voltage waveform is used during set-up, a wall charge accumulates efficiently during the periods when the voltage rises and falls gently (i.e. the periods when the gradient for the voltage variation is no more than 9 V/μs). This means that a wall voltage near the level of the starting voltage can be applied during the set-up period.

Applying a wall voltage near the level of the starting voltage enables a wall charge to be accumulated properly and stable addressing to be performed, even if the pulses applied during the address period are short (no more than 1.5 μs).

Furthermore, the voltage variation from the first to third intervals is a short time (no more than 10 μs). This enables the total time for applying the set-up voltage to be restricted to no more than 360 μs. As a result the proportion of the driving time occupied by the set-up period (the proportion of one field occupied by the set-up period) is shortened.

The total time occupied by the set-up and address periods is thus shortened, allowing the time occupied by the discharge sustain period to be correspondingly lengthened. Alternatively, the total time occupied by the set-up and address periods may be the same as in the related art, while the number of scan electrode lines is increased, so that a high-resolution gas discharge panel is achieved.

A gas discharge panel with a barrier rib group having a height of 80 μm to 110 μm and a barrier rib pitch of 100 μm to 200 μm is particularly effective in achieving a high-resolution display when driven using the above voltage waveform during the set-up period.

BRIEF DESCRIPTION OF DRAWINGS

FIG. 13(*b*) is a schematic of pulse signals; and

BEST MODE FOR CARRYING OUT THE INVENTION

General Explanation of the Construction. Manufacture and Drive Method for a PDP

Figure 1:
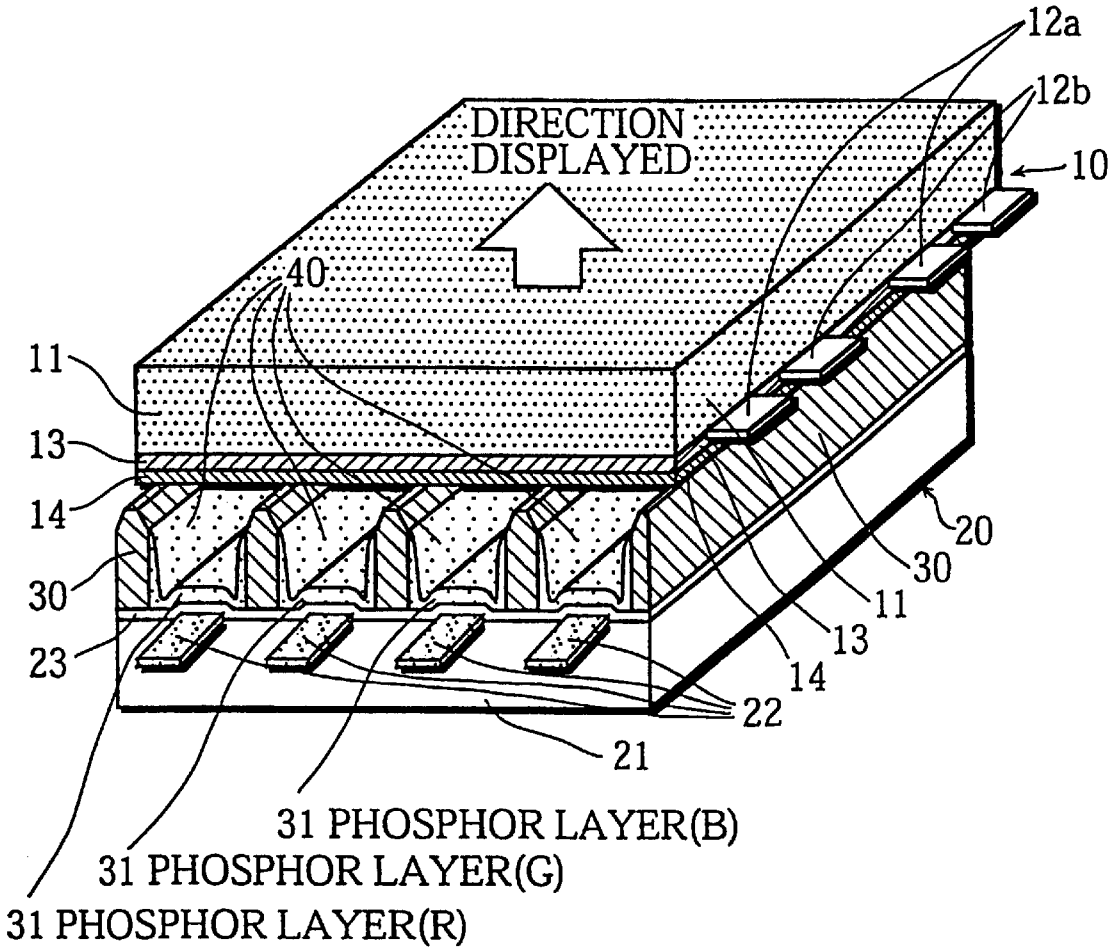
FIG. 1 shows a construction of a AC PDP in the embodiment.

FIG. 1 is a view of a conventional alternating current (AC) PDP.

In this PDP, a front substrate 10 is formed by placing a scan electrode group 12*a* and a sustain electrode group 12*b*, a dielectric layer 13 and a protective layer 14 on a front glass plate 11. A back substrate 20 is formed by placing an address electrode group 22 and a dielectric layer 23 on a back glass plate 21. The front substrate 10 and the back substrate 20 are placed in parallel, leaving a space in between, with the electrode groups 12*a* and 12*b* at right angles to the address electrode group 22. Discharge spaces 40 are formed by dividing the gap between the front substrate 10 and the back substrate 20 with the barrier ribs 30, arranged in stripes. Discharge gas is enclosed in the discharge spaces 40.

A phosphor layer 31 is formed in the discharge spaces 40, on the side nearest to the back substrate 20. The phosphor layer 31 is made up of red, green and blue phosphors lined up in turn.

The scan electrode group 12*a*, the sustain electrode group 12*b* and the address electrode group 22 are all arranged in stripes. The scan electrode group 12*a* and the sustain electrode group 12*b* are both arranged at right angles to the barrier ribs 30, while the address electrode group 22 is parallel to the barrier ribs 30.

The scan electrode group 12*a*, the sustain electrode group 12*b* and the address electrode group 22 may be formed from a simple metal such as silver, gold, copper, chrome, nickel and platinum. However, the scan electrode group 12*a* and the sustain electrode group 12*b* should preferably use composite electrodes formed by laminating a narrow silver electrode on top of a wide transparent electrode made of an electrically-conductive metal oxide such as ITO, $SnO_2$ or ZnO. This is because such electrodes widen discharge area in each cell.

The panel is structured so that cells emitting red, green and blue light are formed at the points where the electrodes groups 12*a* and 12*b* intersect with the address electrodes 22.

The dielectric layer 13 is formed from a dielectric substance and covers the entire surface of the front glass plate 11 on which the electrode groups 12*a* and 12*b* have been arranged. Usually lead glass with a low softening point is used, but bismuth glass with a low softening point, or a laminate of lead glass and bismuth glass with low softening points may also be used.

The protective layer 14 is a thin coating of magnesium oxide (MgO) which covers the entire surface of the dielectric layer 13.

The barrier ribs 30 protrude from the surface of the dielectric layer 23 on the back substrate 20.

Manufacture of the Front Substrate

The front substrate 10 is formed in the following way. The electrode groups 12*a* and 12*b* are formed on the front glass plate 11, and a layer of lead glass applied on top of this and then fired to form the dielectric layer 13. The protective layer 14 is formed on the surface of the dielectric layer 13. Slight indentations and protrusions are then formed in the surface of the protective layer 14.

The electrode groups 12*a* and 12*b* may be formed by a conventional method in which an ITO film is formed by sputtering and unnecessary parts of the film removed by etching. Then silver electrode paste is applied using screen-printing and the result fired. Alternatively, precision-manufactured electrodes may be easily obtained by scanning a nozzle spraying ink including an electrode-forming substance.

The lead compound for the dielectric layer 13 is composed of 70% lead oxide (PbO), 15% diboron trioxide ($B_2O_3$) and 15% silicon dioxide ($SiO_2$), and may be formed by screen-printing and firing. As one specific method, a compound obtained by mixing with an organic binder (α-terpineol in which 10% ethyl cellulose has been dissolved) is applied by screen-printing and then fired at 580° C. for ten minutes.

The protective layer 14 is formed from an alkaline earth oxide (here magnesium oxide is used) and is a thin crystal film with a plane orientation of (100) or (110). This kind of protective layer may be formed using a vaporization method, for example.

Manufacture of the Back Substrate

The back substrate is manufactured in the following way. The address electrode group 22 is formed on the top glass plate 21 by using screen-printing to apply a silver electrode paste and then firing the result. The dielectric layer 23 is formed on top of this from lead glass using screen-printing and firing in the same way as for the dielectric layer 13. Next, the glass barrier ribs 30 are attached at a specified pitch. Then, one out of the red, green and blue phosphors is applied to each of the spaces created between the barrier ribs 30, and then the panel is fired, forming the phosphor layer 31. Phosphors conventionally used in PDPs may be used for each color. The following are specific examples of such phosphors:

Red phosphor: $(Y_xGd_{1-x})BO_3:Eu^{3+}$

Green phosphor: $BaAl_{12}O_{19}:Mn$

Blue phosphor: $BaMgAl_{14}O_{23}:Eu^{2+}$

Fixing the Substrates Together to Manufacture the PDP

The PDP is manufactured in the following way. First, front and back substrates manufactured as described above are fixed together using sealing glass while the discharge spaces 40 created by the barrier ribs 30 are evacuated, forming a high vacuum of around $1\times10^{-4}$ Pa. Following this, discharge gas of a specific mixture (for example neon/xenon or helium/xenon) is enclosed in the discharge spaces 40 at a specified pressure.

The pressure at which the discharge gas is enclosed is conventionally no higher than atmospheric pressure, normally in a range of about $1\times10^4$ Pa to $7\times10^4$ Pa. Setting a pressure higher than atmospheric pressure (i.e., $8\times10^4$ Pa or above), however, improves panel luminance and luminous efficiency.

Figure 2:
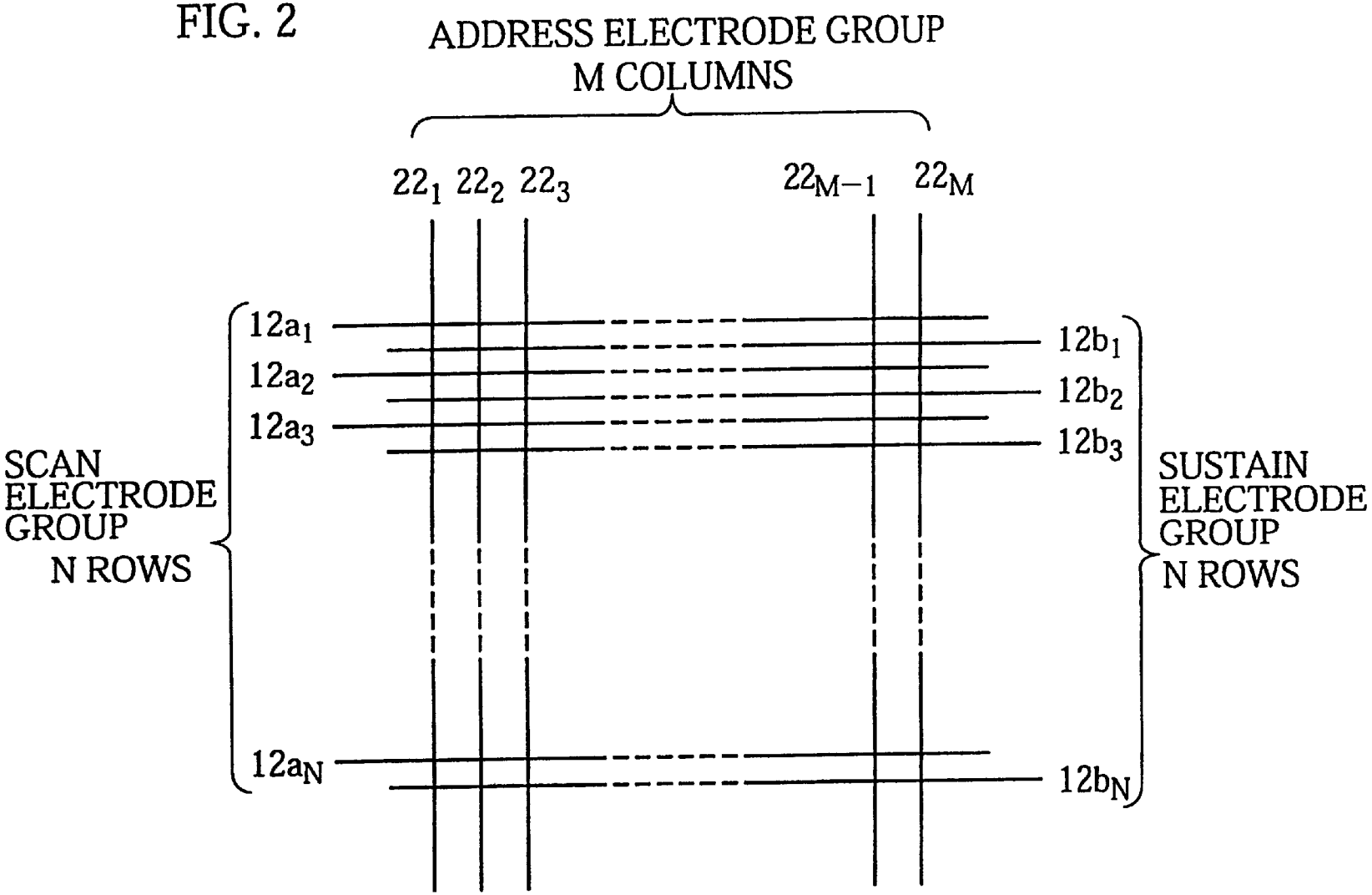
FIG. 2 shows the electrode matrix for the PDP.

FIG. 2 shows the electrode matrix of the PDP.

Electrode lines 12*a* and 12*b* are arranged at right angles to address electrode lines 22. Discharge cells are formed in the space between the front glass plate 11 and the back glass plate 21, at the points where the electrode lines intersect. The barrier ribs 30 separate adjacent discharge cells, preventing discharge diffusion between adjacent discharge cells so that a high resolution display can be achieved.

The PDP is driven using the ADS sub-field drive method.

Figure 3:
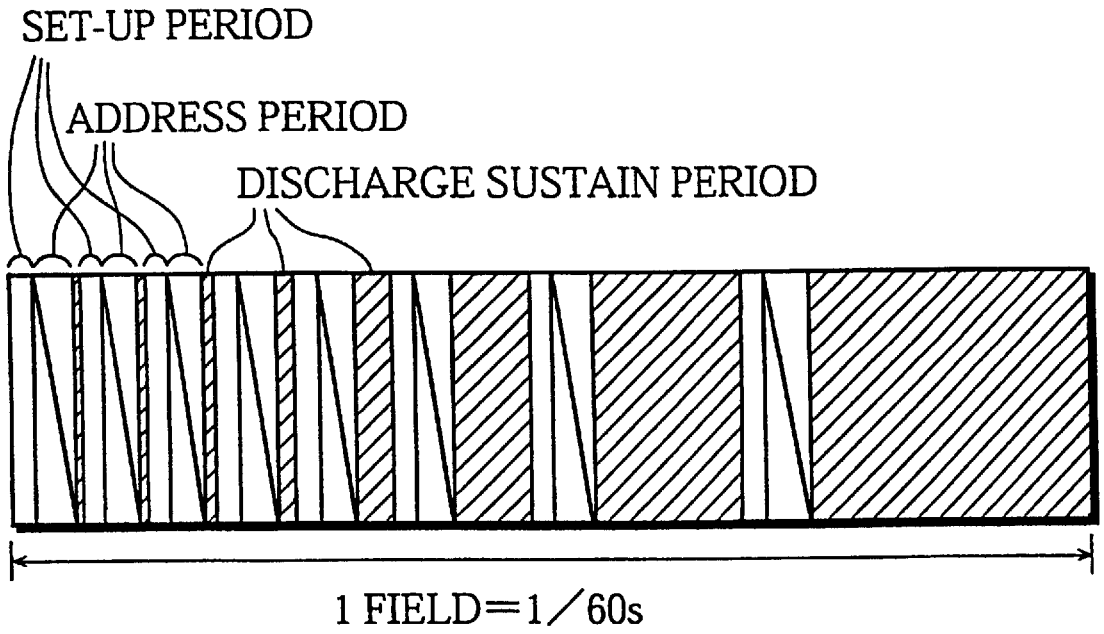
FIG. 3 shows a division method for one field when a 256-level gray scale is expressed by the ADS sub-field drive method.

FIG. 3 shows a division method for one field when a 256-level gray scale is expressed. Time is plotted along the horizontal axis and the shaded parts represent discharge sustain periods.

In the example division method shown in FIG. 3, one field is made up of eight sub-fields. The ratios of the discharge sustain period for the sub-fields are set respectively at 1, 2, 4, 8, 16, 32, 64, and 128. Eight-bit binary combinations of the sub-fields express a 256-level gray scale. The NTSC (National Television System Committee) standard for television images stipulates a rate of 60 field-images per second, so the time for one field is set at 16.7 ms.

Each sub-field is composed of the following sequence: a set-up period, an address period and a discharge sustain period. The display of an image for one field is performed by repeating the operations for one sub-field eight times.

Figure 4:
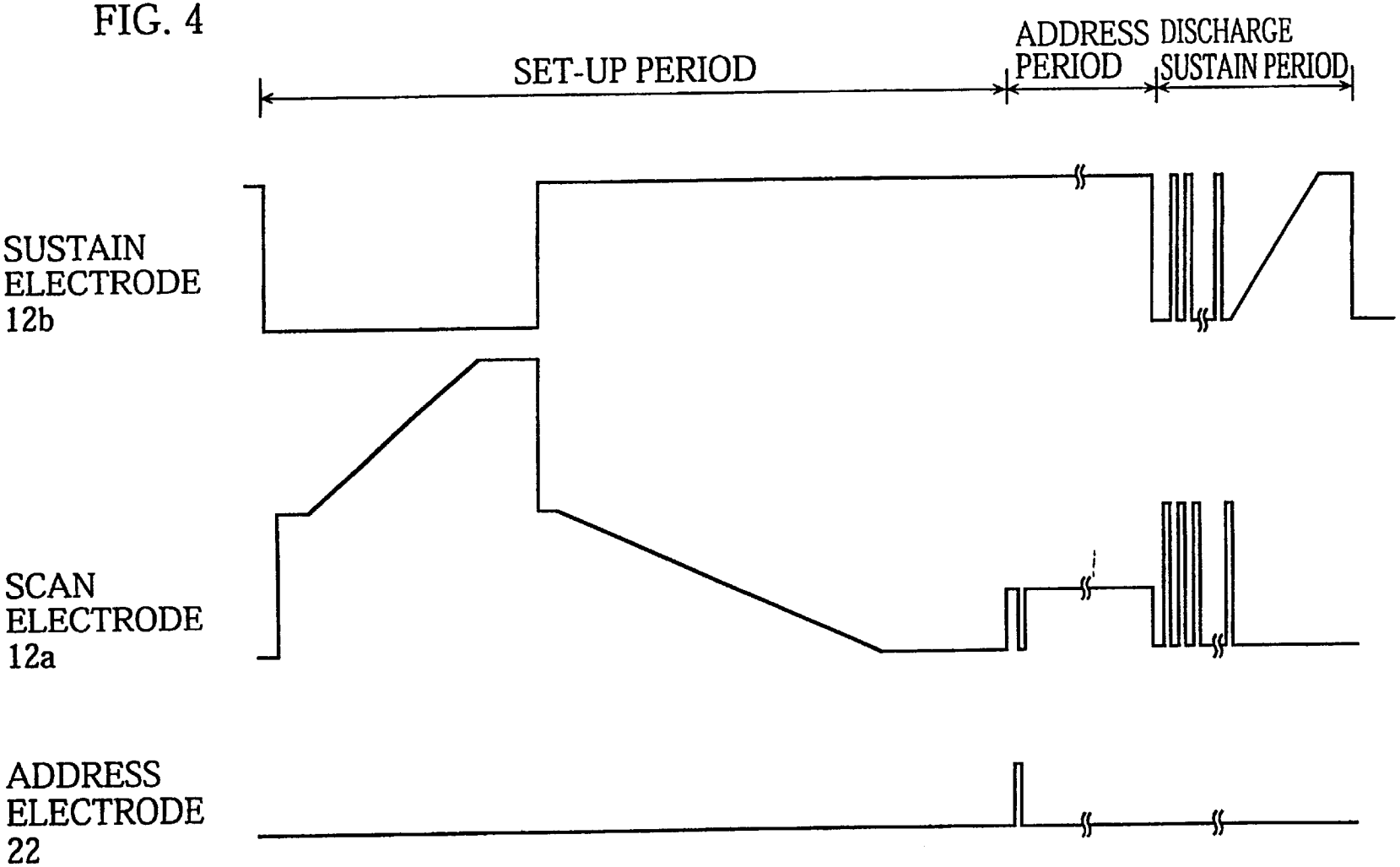
FIG. 4 is a time chart showing pulses applied to electrodes in one sub-field in the embodiment.

FIG. 4 is a time chart showing pulses applied to electrodes during one sub-field in the present embodiment.

The operations performed in each period are explained in detail later in this description. In the address period, pulses are applied sequentially to a plurality of scan electrode lines and simultaneously to selected address electrode lines but, for the sake of convenience, FIG. 4 shows just one scan electrode line and one address electrode line.

Detailed Explanation of Drive Apparatus and Drive Method

Figure 5:
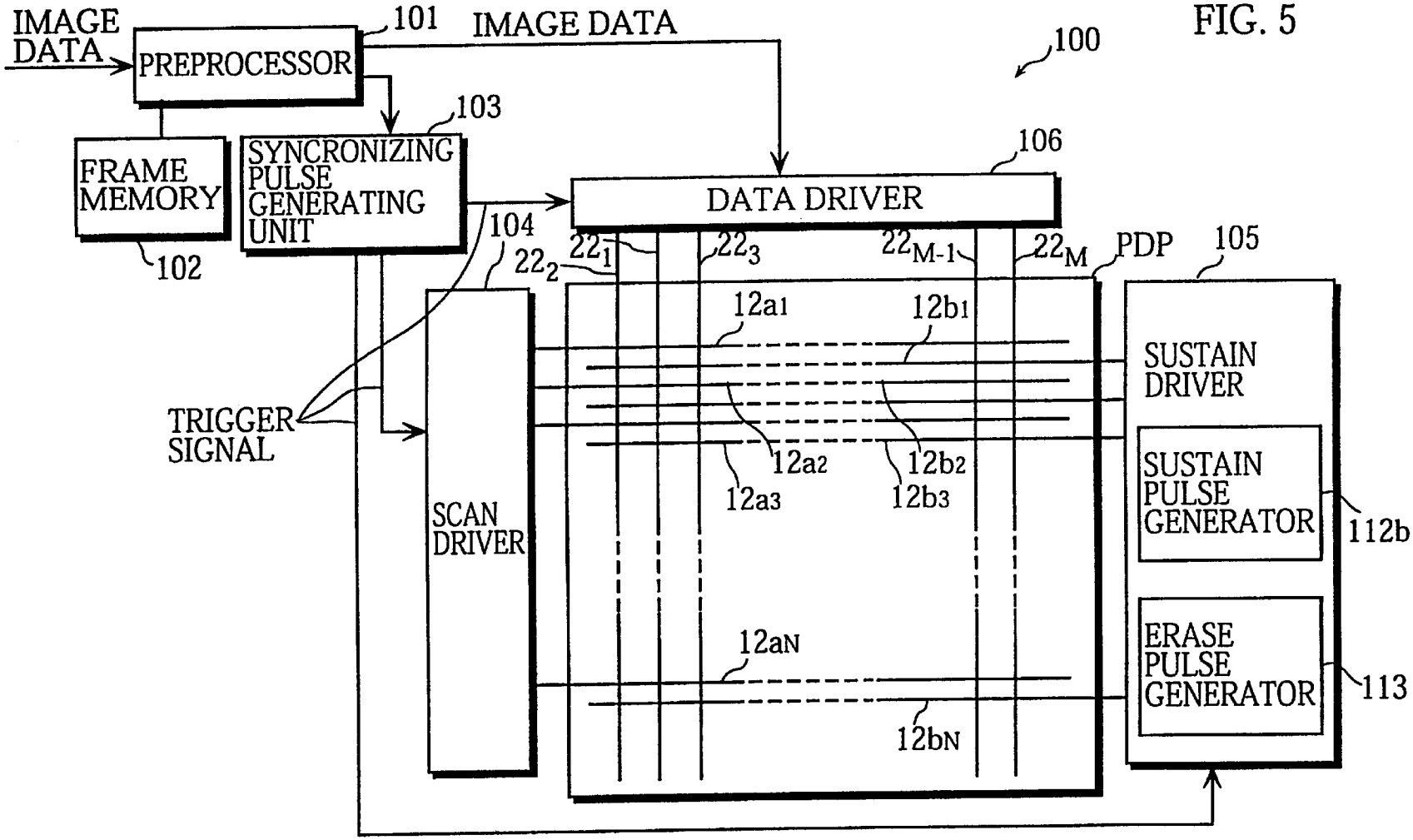
FIG. 5 is a block diagram showing a construction of a drive apparatus for driving the PDP.

FIG. 5 is a block diagram showing a structure of a drive apparatus 100.

The drive apparatus 100 includes a preprocessor 101, a frame memory 102, a synchronizing pulse generating unit 103, a scan driver 104, a sustain driver 105 and a data driver 106. The preprocessor 101 processes image data input from an external image output device. The frame memory 102 stores the processed data. The synchronizing pulse generating unit 103 generates synchronizing pulses for each field and each sub-field. The scan driver 104 applies pulses to the scan electrode group 12*a*, the sustain driver 105 to the sustain electrode group 12*b*, and the data driver to the address electrode group 22.

The preprocessor 101 extracts image data for each field (field image data) from the input image data, produces image data for each sub-field (sub-field image data) from the extracted image data and stores it in the frame memory 102. The preprocessor 101 then outputs the current sub-field image data stored in the frame memory 102 line by line to the data driver 106, detects synch signals such as horizontal synch signals and vertical synch signals from the input image data and sends synch signals for each field and sub-field to the synchronizing pulse generating unit 103.

The frame memory 102 is capable of storing the data for each field separated into sub-field image data for each sub-field.

Specifically, the frame memory 102 is a two-port frame memory provided with two memory areas each capable of storing data for one field (eight sub-field images). An operation in which field image data is written in one memory area, while the field image data written in the other frame memory area is read can be performed alternately on the memory areas.

The synchronizing pulse generating unit 103 generates trigger signals indicating the timing with which each of the set-up, scan, sustain and erase pulses should rise. These trigger signals are generated with reference to the synch signals received from the preprocessor 101 for each field and sub-field, and sent to the drivers 104 to 106.

The scan driver 104 generates and applies the set-up, scan and sustain pulses in response to trigger signals received from the synchronizing pulse generating unit 103.

Figure 6:
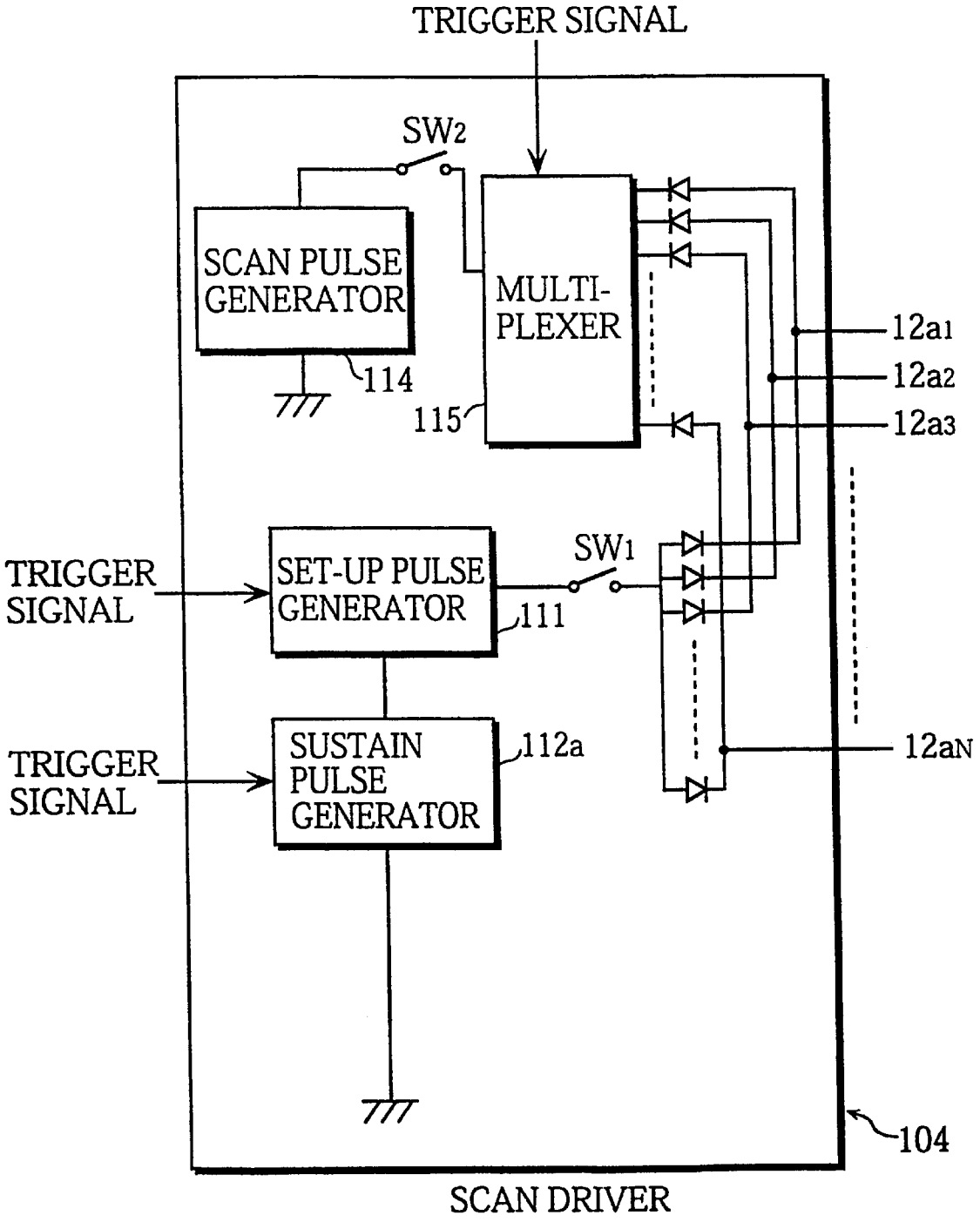
FIG. 6 is a block diagram showing a construction of a scan driver in FIG. 5.

FIG. 6 is a block diagram showing a structure of the scan driver 104.

The set-up and sustain pulses are applied to all of the scan electrode lines 12*a*.

As a result, the scan driver 104 has a set-up pulse generator 111 and a sustain pulse generator 112*a*, as shown in FIG. 6. The two pulse generators are connected in series using a floating ground method and apply the set-up and sustain pulses in turn to the scan electrode group 12*a*, in response to trigger signals from the synchronizing pulse generating unit 103.

As shown in FIG. 6, the scan driver 104 also includes a scan pulse generator 114 which, along with a multiplexer 115 to which it is connected, enables the scan pulses to be applied in sequence to the scan electrode lines $12a_1$, $12a_2$ and so on, until $12a_N$. Pulses are generated in the scan pulse generator 114 and output switched by the multiplexer 115, in response to trigger signals from the synchronizing pulse generating unit 103. Alternatively, a structure in which a separate scan pulse generating circuit is provided for each scan electrode line 12*a* may also be used.

Switches $SW_1$ and $SW_2$ are arranged in the scan driver 104 to selectively apply the output from the above pulse generators 111 and 112 and the output from the scan pulse generator 114 to the scan electrode group 12*a*.

The sustain driver 105 has a sustain pulse generator 112*b* and an erase pulse generator 113, generates sustain and erase pulses in response to trigger signals from the synchronizing pulse generating unit 103, and applies the sustain and erase pulses to the sustain electrode group 12*b*.

The data driver 106 outputs data pulses (also referred to as address pulses) in parallel to the address electrode lines $22_1$ to $22_M$. Output takes place based on sub-field information corresponding sub-field data which is input serially into the data driver 106 a line at a time.

Figure 7:
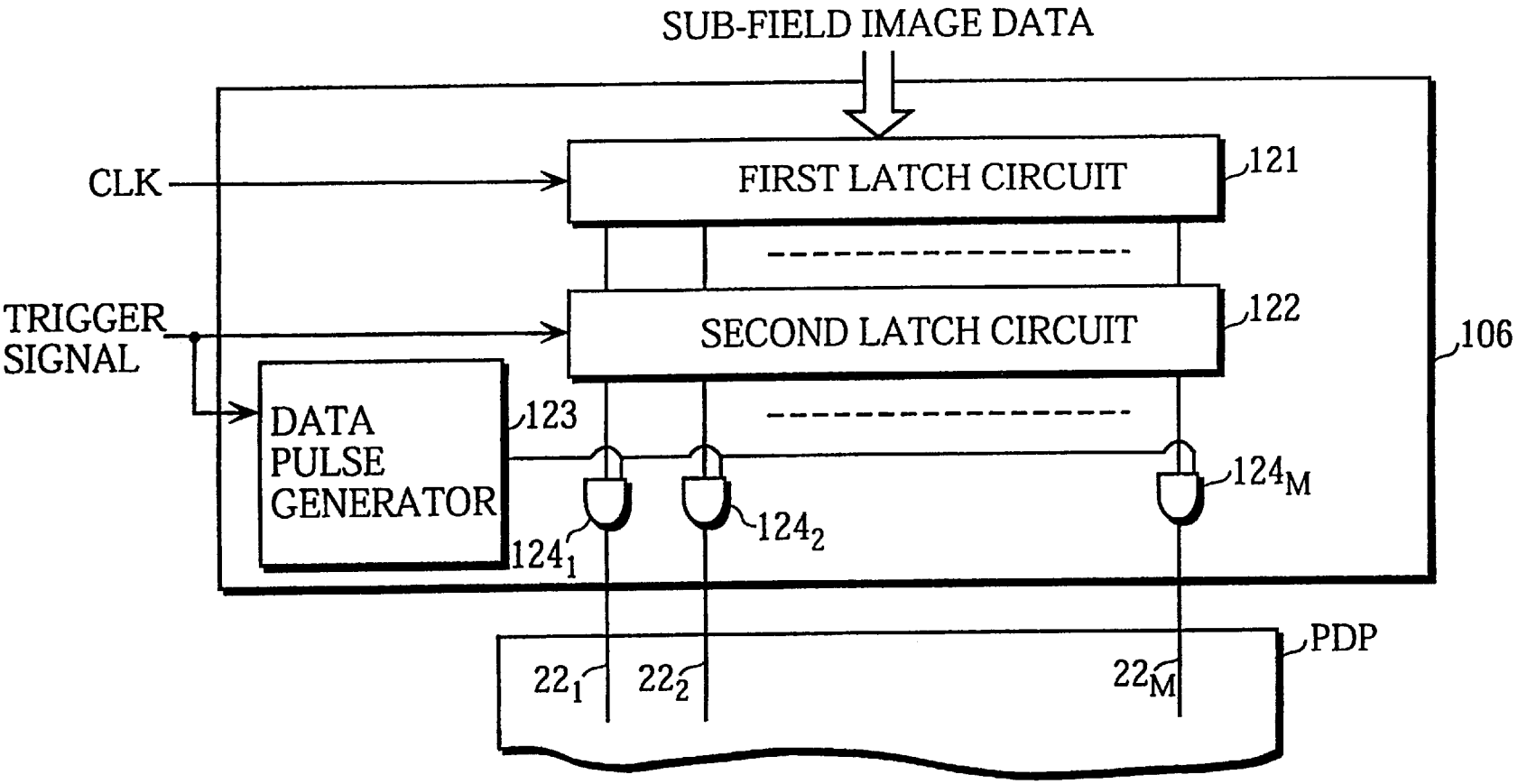
FIG. 7 is a block diagram showing a construction of a data driver in FIG. 5.

FIG. 7 is a block diagram of a structure for the data driver 106.

The data driver 106 includes a first latch circuit 121 which fetches one scan line of sub-field data at a time, a second latch circuit 122 which stores one line of sub-field data, a data pulse generator 123 which generates data pulses, and AND gates $124_1$ to $124_M$ located at the entrance to each address electrode line $22_1$ to $22_M$.

In the first latch circuit 121, sub-field image data sent in order from the preprocessor 101 is fetched sequentially so many bits at a time in synchrony with CLK (clock) signals. Once one scan line of sub-field image data (information showing whether each of the address electrode lines $22_1$ to $22_M$ is to have a data pulse applied) has been latched, it is transferred to the second latch circuit 122. The second latch circuit 122 opens the AND gates belonging to the address electrode lines 22 that are to have the pulses applied, in response to trigger signals from the synchronizing pulse generating unit 103. The data pulse generator 123 simultaneously generates the data pulses, so that the data pulses are applied to the address electrode lines 22 with open AND gates.

A drive apparatus such as this one applies voltages to each electrode during each set-up, address and discharge sustain period as described below.

Explanation of Operations Performed in Each Period Set-up Period

In the set-up period, switches $SW_1$ and $SW_2$ in the scan driver 104 are ON and OFF respectively. The set-up pulse generator 111 applies a set-up pulse to all of the scan electrodes 12*a*. This causes a set-up discharge to occur in all of the discharge cells.

The set-up discharge occurs between three electrode groups; that is, between scan electrodes and address electrodes, and between scan electrodes and sustain electrodes. This initializes each discharge cell and a wall charge accumulates inside them, triggering a wall voltage. As a result, address discharge occurring in the following address period can commence sooner.

The set-up pulse waveform has characteristics suitable for generating a wall voltage close to the level of the discharge starting voltage (hereafter referred to as the starting voltage) in the brief time occupied by each pulse (360 $\mu$s or less). This characteristic will be explained in more detail later in this description.

Note that a positive voltage is applied to the sustain electrode group 12*b* from the second half of the set-up period until the completion of the address period. This makes it easier for a wall charge to accumulate on the surface of the electric layer during the address period.

Address Period

In the address period, the switches $SW_1$ and $SW_2$ in the scan driver 104 are OFF and ON respectively. Negative scan pulses generated by the scan pulse generator 114 are applied sequentially from the first row of scan electrodes $12a_1$ to the last row of scan electrodes $12a_N$. With appropriate timing, the data driver 106 generates an address discharge by applying positive data pulses to the data electrodes $22_1$ to $22_M$ corresponding to the discharge cells to be lit, accumulating a wall charge in these discharge cells. Thus, a one-screen latent image is written by accumulating a wall charge on the surface of the dielectric layer in the discharge cells which are to be lit.

The scan pulses and the data pulses (in other words the address pulses) should be set as short as possible to enable driving to be performed at high speed. However, if the address pulses are too short, write defects (address discharge defects) are likely. Additionally, limitations in the type of circuitry that may be used mean that the pulse length usually needs to be set at about 1.25 $\mu$s or more.

Should addressing be performed using the dual scanning method, the address electrode group 22 shown in FIG. 2 is divided into upper and lower halves and the drive apparatus 100 applies separate pulses simultaneously to the upper and lower halves of each address electrode 22. Thus the addressing described above is performed in parallel on the upper and lower halves of the PDP.

Discharge Sustain Period

In the discharge sustain period, the switches $SW_1$ and $SW_2$ in the scan driver 104 are ON and OFF respectively. Operations in which the sustain pulse generator 112*a* applies a discharge pulse of a fixed length (for example 1 $\mu$s to 5 $\mu$s) to the entire scan electrode group 12*a* and in which the sustain pulse generator 112*b* applies a discharge pulse of a fixed length to the entire sustain electrode group 12*b* are alternated repeatedly.

This operation raises the potential of the dielectric layer surface in discharge cells in which a wall charge had accumulated during the address period above the starting voltage. This generates a sustain discharge, causing ultraviolet light to be emitted within the discharge cells. Visible light corresponding to the color of the phosphor layer in each discharge cell is emitted when the phosphor layer 31 changes the ultraviolet light to visible light.

In the last part of the discharge sustain period, a voltage the same as the sustain pulse with a ramp of around 3 V/$\mu$s to 9 V/$\mu$s in its rise time is applied to the sustain electrodes 12*b* for a short time of around 20 $\mu$s to 50 $\mu$s. This erases the wall charge remaining in the lit cells.

Voltage Waveform Applied During the Set-up Period

Figure 8:
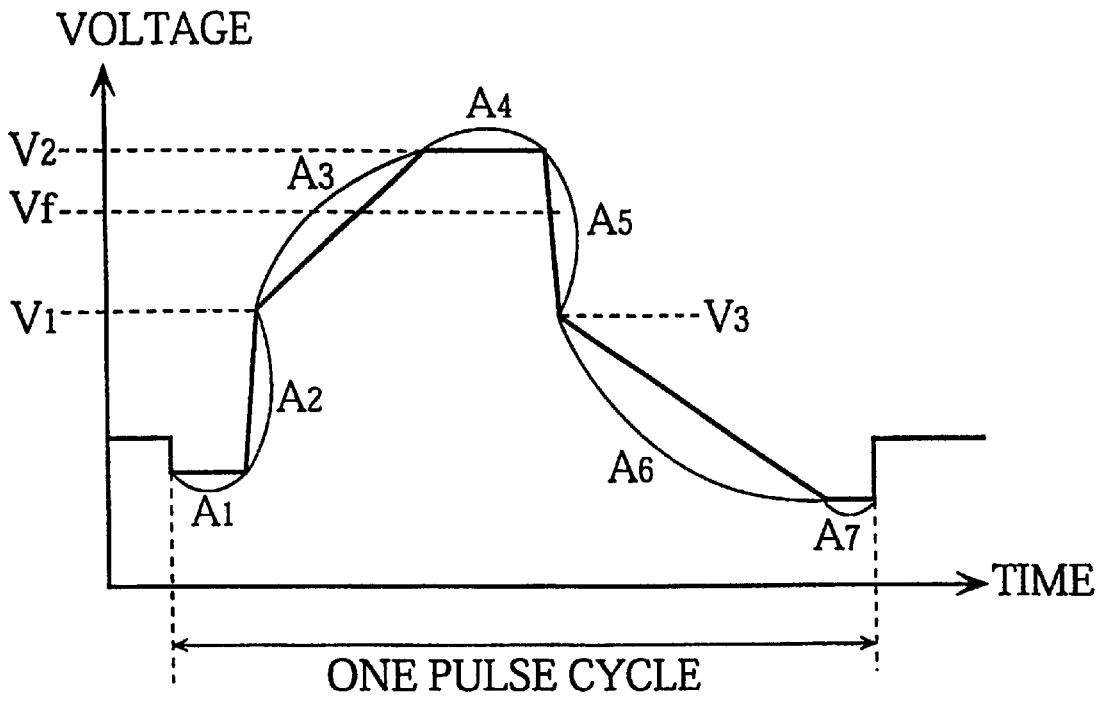
FIG. 8 shows a waveform for the set-up pulse in the embodiment.

FIG. 8 explains the set-up pulse waveform. As shown in the drawing, this pulse waveform can be divided into intervals $A_1$ to $A_7$.

In the set-up period in the present embodiment, a set-up pulse with this kind of waveform is applied to the scan electrode group 12*a*.

The potential of the address electrode group 22 is maintained at 0 while the set-up is being applied to the scan electrode group, as is shown in FIG. 4. This means that the potential difference between the scan electrode group 12*a* and the address electrode group 22 has a waveform like the one in FIG. 8.

This set-up pulse waveform is set in the following way, taking into consideration the need to accumulate a wall charge on the dielectric layer surface in as short a time as possible. The wall charge corresponds to a wall voltage near to the level of the starting voltage.

Interval $A_1$ is a time adjustment period.

In interval $A_2$, the voltage is raised to a level $V_1$ near to a starting voltage $V_f$ in as short a time as possible (no more than 10 μs). Here the voltage $V_1$ is set in the range $100 \leqq V_1 < V_f$. Note that $V_f$ is the starting voltage as viewed externally (from the drive apparatus).

The starting voltage $V_f$ is a fixed value determined by the structure of the PDP, and may be measured, for example, using the following method.

Keeping the gas discharge panel under visual observation, the voltage from the panel drive apparatus applied between the scan electrode group 12*a* and the sustain electrode group 12*b* is increased little by little. Then, the applied voltage when either one or a specific number, say three, of the discharge cells in the gas discharge panel, lights up and is read as the starting voltage.

Next, in interval $A_3$, the voltage is raised slowly to voltage $V_2$, and sustained at voltage $V_2$ for interval $A_4$. Here, voltage $V_2$ is at a value higher than starting voltage $V_f$, but if it is set too high, a self-erasing discharge may occur when the voltage falls. Therefore, voltage $V_2$ needs to be set so that self-erasing discharge cannot occur, that is in the range of 450 V to 480 V.

The gradient of the voltage rise in interval $A_3$ should be not more than 9 V/μs and preferably between 1.7 V/μs and 7 V/μs. By raising the voltage slowly in this way, a weak discharge is generated in an area where I–V characteristics are positive, discharge is generated with a voltage near to low-voltage mode, and the voltage inside the discharge cells is maintained in the vicinity of a value $V_f^*$, slightly lower than the starting voltage $V_f$. As a result, a negative wall charge corresponding to the potential difference $V_2 - V_f^*$ accumulates on the surface of the dielectric layer 13 covering the scan electrode group 12*a*.

The amount of time allocated to interval $A_3$ is between 100 μs and 250 μs, and should preferably be in the range of 100 μs to 150 μs.

Interval $A_4$, which corresponds to the peak of the waveform, should preferably be set as short as possible, but conditions relating to the circuitry of the panel drive apparatus mean that it actually lasts for several μs.

Next, in interval $A_5$, the voltage is lowered to a voltage $V_3$, which is at least 50 V and no higher than the starting voltage $V_f$, in as short a time as possible (no more than 10 μs).

Then, in interval $A_6$, the voltage is slowly lowered. The gradient of the voltage fall in interval $A_6$ is no more that 9 V/μs, and should preferably be between 0.6 V/μs and 3 V/μs. When the electric potential of the surface of the dielectric layer covering the scan electrode group 12*a* exceeds the real starting voltage inside the cells, lowering the voltage slowly in this way generates a weak discharge in the area with positive characteristics, and voltage inside the cells can be kept at a value $V_f^*$, slightly lower than the starting voltage $V_f$. Consequently, a state in which a negative wall charge corresponding to the starting voltage $V_f$ is accumulated on the surface of the dielectric layer above the scan electrodes 12*a* is preserved.

Interval $A_7$ is a time adjustment period.

By setting the voltage waveform for the set-up pulse in this way, a wall voltage close to the level of the starting voltage can be applied very efficiently inside each cell during a short pulse application period of no more than 360 μs. Additionally, even if the pulse applied during the address period is a short one of no more than 1.5 μs, the wall charge required for addressing can be accumulated without any discharge delay being caused.

As a result, even when a high-resolution image with 1080 scanning lines is displayed, image display can take place preserving a discharge sustain period similar to that of a PDP with 480 scanning lines conforming to the VGA (visual graphics array) protocol.

Here, use of the set-up waveform of this embodiment, shown in FIG. 8, is compared with use of a number of set-up waveforms from the related art.

Firstly, the voltage in the set-up waveform in FIG. 8 is slowly raised and lowered in intervals $A_3$ and $A_6$, to avoid generating a strong discharge. This enables a large wall charge to be accumulated. Also, since raising and lowering the voltage sharply in intervals $A_2$ and $A_5$ has no effect on wall charge accumulation, the time required for set-up can be kept short by setting high voltage gradients. This means that the total length of a whole set-up pulse is no more than 360 μs, and sufficient wall charge can be accumulated.

Figure 9:
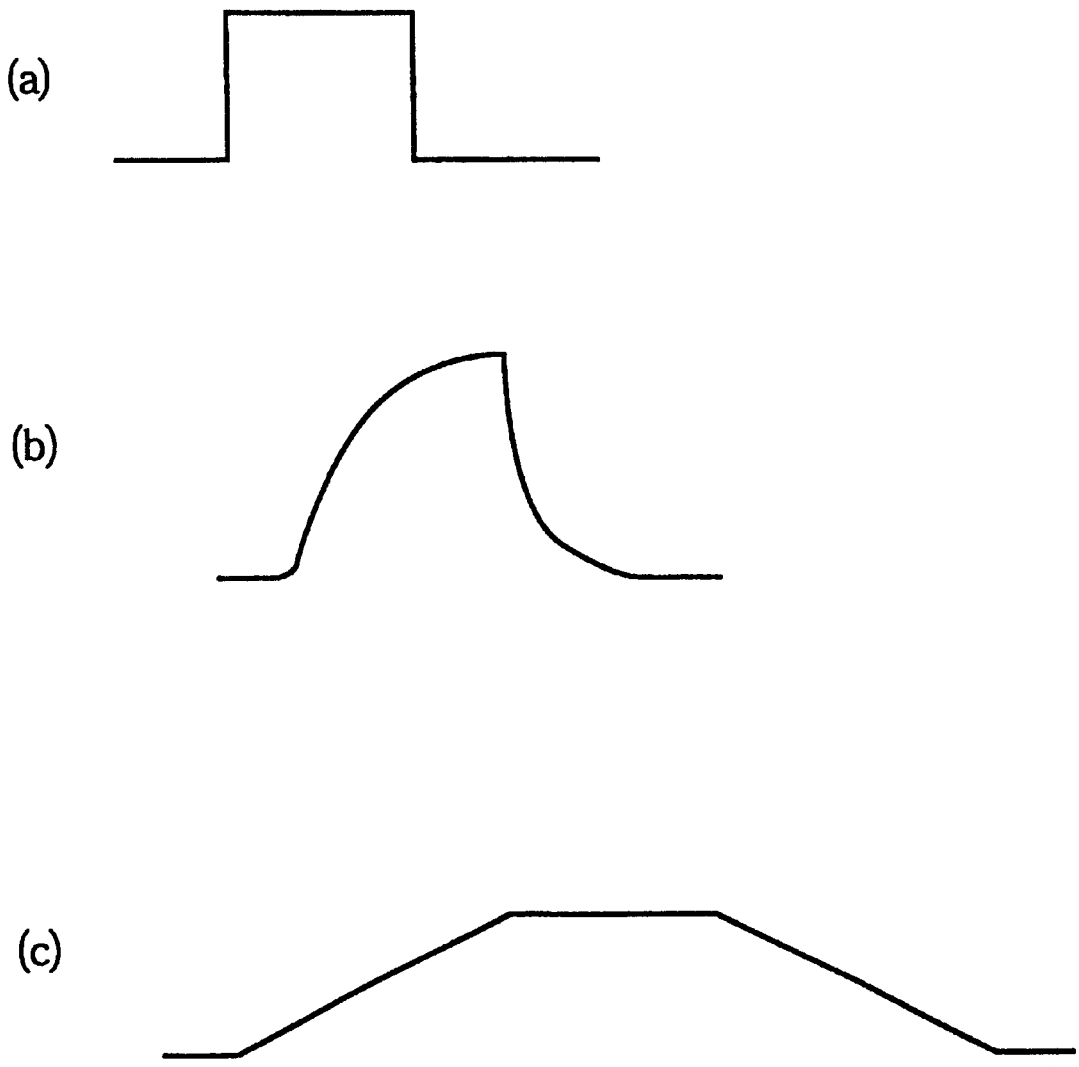
FIG. 9 shows drawings comparing pulse waveforms applied when set-up is performed.

When, using a simple rectangular wave like the one in FIG. 9A, or a waveform based on an exponential or logarithmic function like the one in FIG. 9B, a sudden rise and fall in voltage occurs in the parts of the waveform corresponding to intervals $A_3$ and $A_6$. This generates a strong discharge, preventing a wall charge from accumulating as it does in the embodiment.

When only a small amount of wall charge is accumulated during the set-up period, the use of an address pulse of around 1.5 μs in length will cause discharge delay, generating erratic address discharge and screen flicker. In this case, the address pulse needs to be set at a length of no less than 2.5 μs in order to ensure that address discharge occurs properly. If there are 1080 scan lines this means that the time required for addressing will be at least 2.7 ms.

Alternately, suppose a ramp waveform in which the voltage rises and falls gently, such as the one in FIG. 9C, is used. A more detailed explanation of this type of waveform can be found in U.S. Pat. No. 5,745,086. In this case, a wall voltage close to the level of the starting voltage is applied, accumulating a wall charge, but set-up itself is time-consuming and cannot be limited to around 360 μs.

In the set-up waveform of FIG. 8, however, a wall voltage near to the level of the starting voltage can be applied, so that addressing can be performed stably, even with an extremely short address pulse of no more than 1.25 μs. Accordingly, addressing can be performed in 1350 μs or less when the number of scan lines is 1080. Since the entire set-up waveform requires 360 μs or less, the total time required for set-up and addressing combined can be limited to 1710 μs or less.

This means that even if there are eight sub-fields, the total time remaining for the discharge sustain period in one field is at least 16.7–(1.71×8) ms, that is 3 ms, so that sufficient time can be allotted to the discharge sustain period.

Taking the above into consideration, it can be seen that using the set-up waveform of the present embodiment enables the total time required for set-up and addressing to be restricted to a lower level than in the related art.

In other words, even if the number of scan electrodes is higher than in the related art, the total time required for set-up and addressing is restricted to the same level. This in turn allows the percentage of time occupied by the is discharge sustain period to be maintained at the same level as in the related art.

Therefore, the present embodiment is effective in realizing a high-resolution PDP with excellent panel luminance.

Furthermore, when addressing is performed using the dual scanning method, the proportion of time occupied by the discharge sustain period is greater than when a single scanning method is used.

Suppose that there are 1080 scan lines, and the address pulse is 1.25 μs. Here, if the dual scanning method is performed, eight sub-fields can be realized in 6×speed mode, twelve sub-fields in 3×speed mode, and fifteen sub-fields in 1×speed mode.

Here, n×speed mode refers to a mode in which a sustain pulse is applied during the discharge sustain period n× the number of times it is applied in 1×speed mode. As the number of sustain pulses increases, so does panel luminance.

Circuit for Forming the Set-up Pulse Waveform

Figure 10:
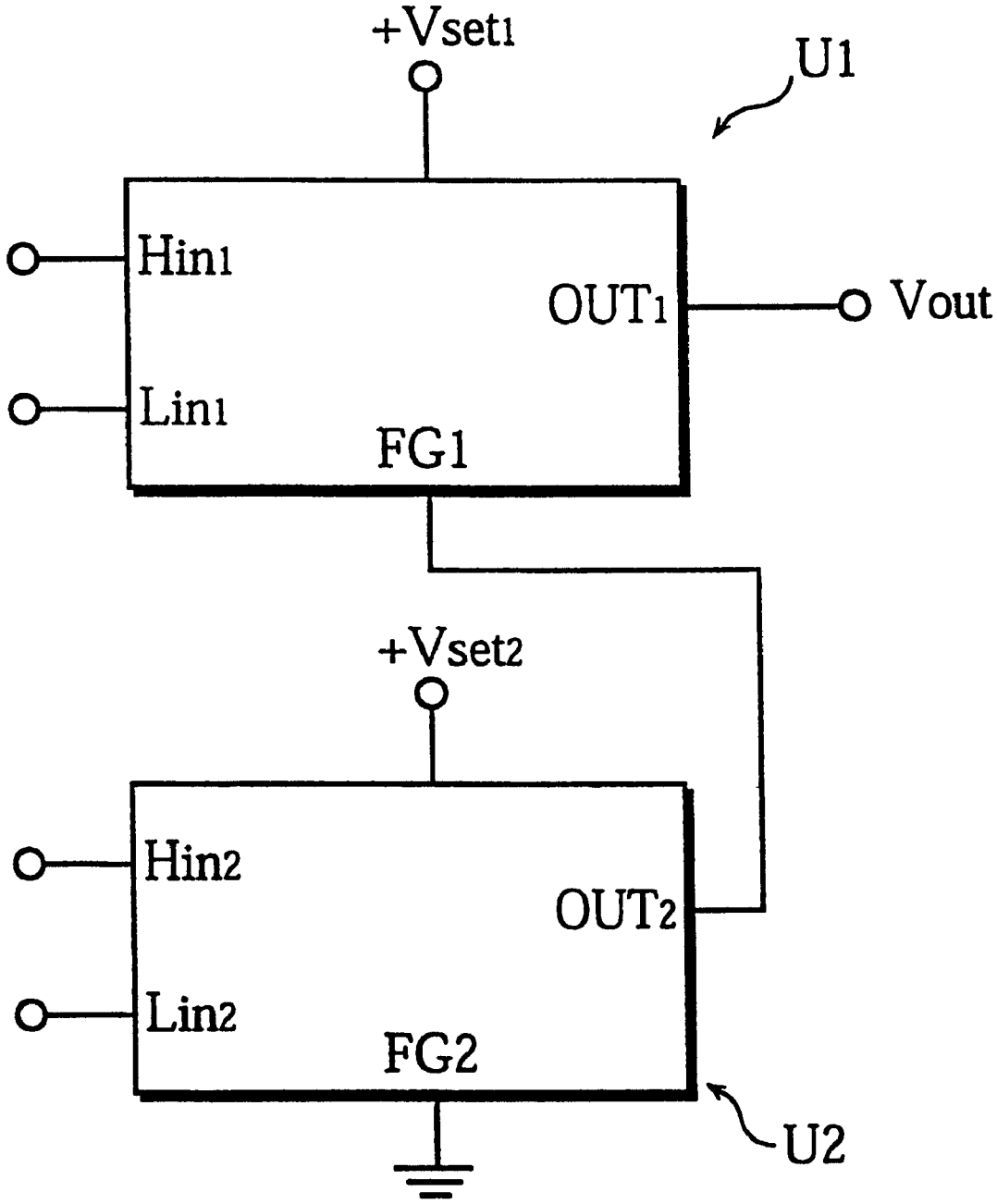
FIG. 10 is a block diagram of a pulse combining circuit forming set-up pulses in the embodiment.

A pulse generating circuit such as the one in FIG. 10 may be used in the set-up pulse generator 111 shown in FIG. 6, in order to apply a waveform having the above characteristics as a set-up pulse to the scan electrode group 12*a*.

The pulse generating circuit shown in FIG. 10 is constructed from a pulse generating circuit U1 for generating a first pulse with a gently-rising gradient, and a pulse generating circuit U2 for generating a second pulse with a gently-falling gradient. The first and second pulse generating circuits U1 and U2 are connected by a floating-ground method.

The first and second pulse generating circuits U1 and U2 generate first and second pulses in response to trigger signals sent from the synchronizing pulse generating unit 103.

Figure 11:
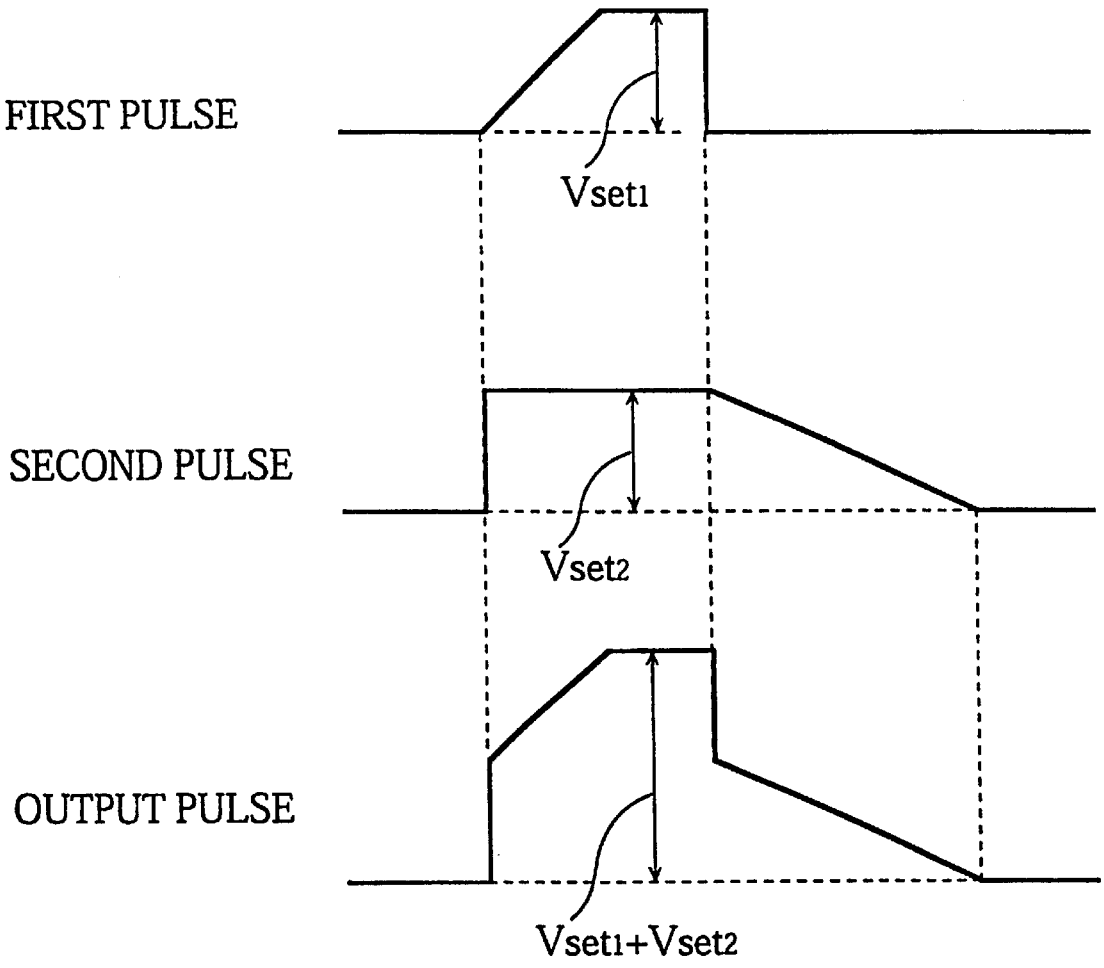
FIG. 11 shows the situation when first and second pulses are combined by the pulse combining circuit.

Here, as shown in FIG. 11, the pulse generating circuit U1 generates a ramped first pulse with a gentle rise and the pulse generating circuit U2 simultaneously generates a ramped second pulse with a gentle fall. Furthermore, the start of the rise time for the first pulse and the rise time for the second pulse are virtually identical, as are the start of the fall time for the second pulse and the fall time for the first pulse. A pulse waveform having the same characteristics as the one in FIG. 8 is produced by forming an output pulse by adding the voltages of the two pulses together.

Figure 12:
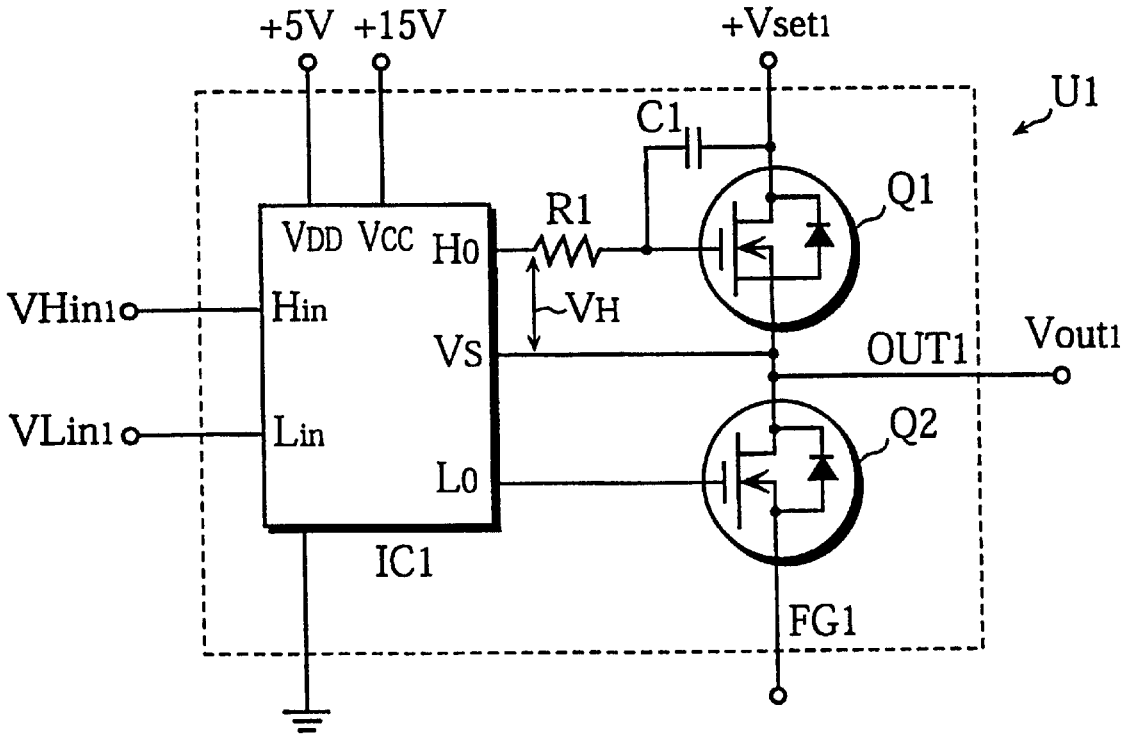
FIG. 12(*a*) and FIG. 12(*b*) explain an alternative example of a PDP drive method in the embodiments.
Figure 12:
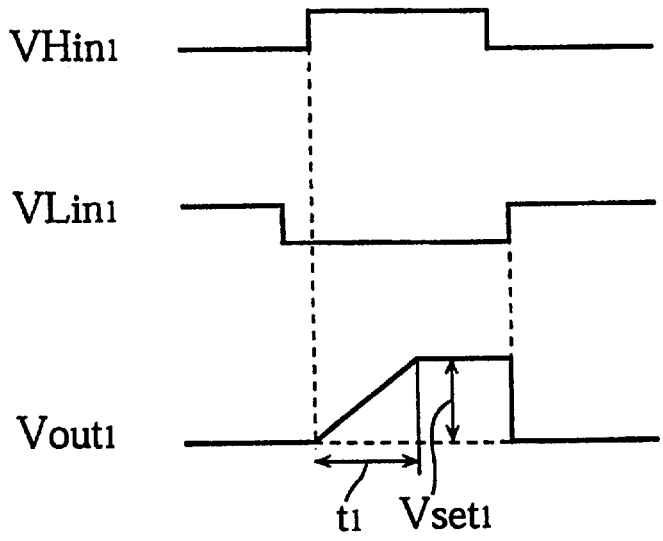
Figure 13:
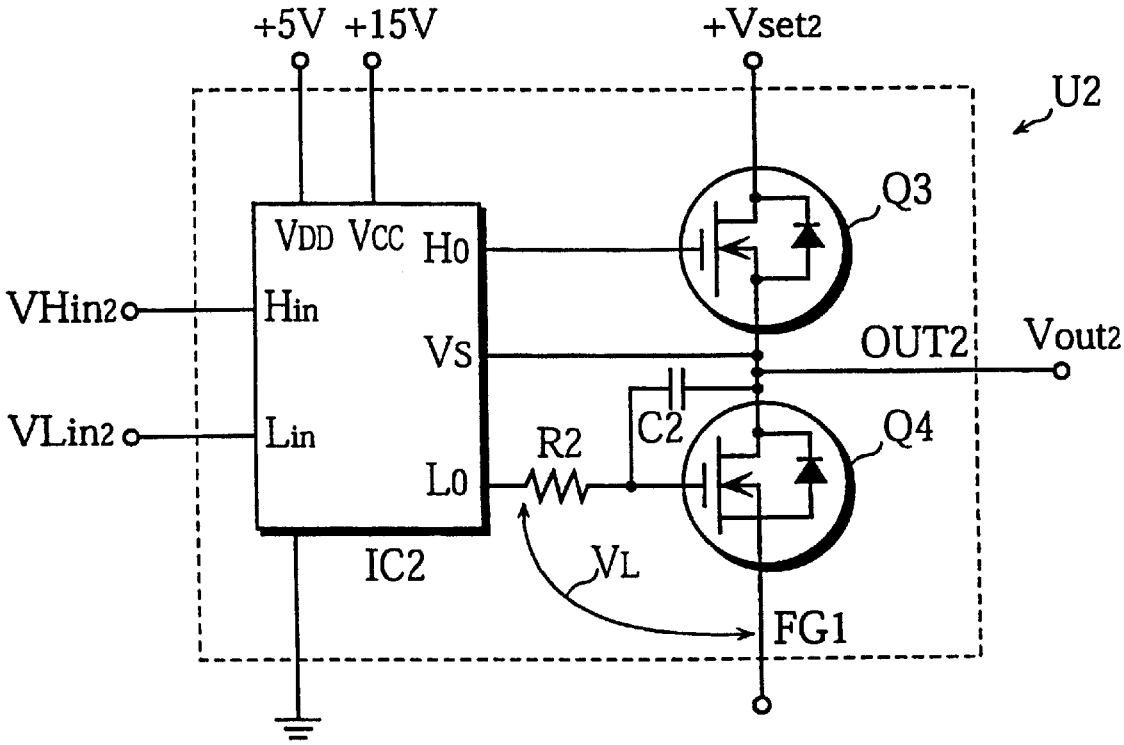
FIG. 13(*a*) is a pulse generating circuit.
Figure 13:
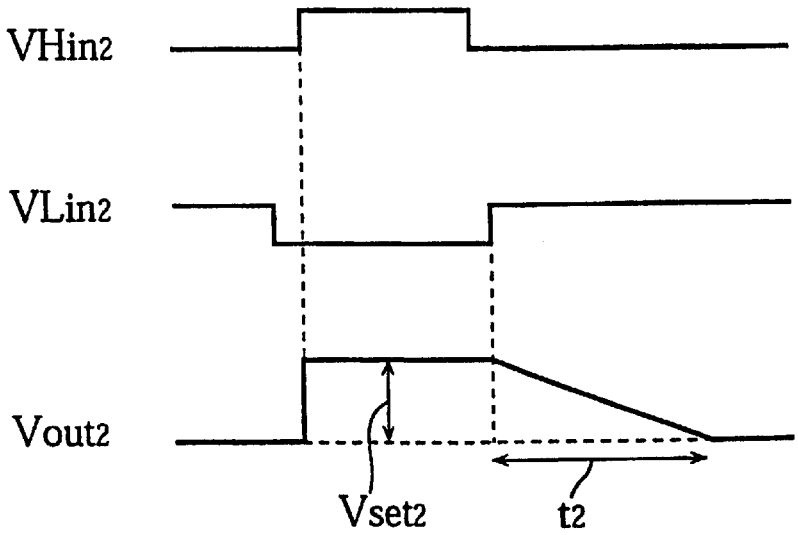

FIG. 12A and FIG. 13A are block diagrams showing a construction for the pulse generating circuit U1 and the pulse generating circuit U2 respectively.

The pulse generating circuits U1 and U2 have the following constructions.

As shown in FIG. 12A, the pulse generating circuit U1 is a push-pull circuit connected to an IC1 (for example IR-2113 manufactured by International Recifier). The IC1 is a three-phase bridge driver and the push-pull circuit is composed of a pull-up FET (field-effect transistor) Q1 and a pull-down FET Q2. A capacitor C1 is inserted between the gate and drain of the pull-up FET Q1, and a current limiting component R1 is inserted between a terminal $H_0$ of the $IC_1$ and the gate of the pull-up FET Q1. A uniform voltage $V_{set1}$ is applied to the push-pull circuit. This voltage $V_{set1}$ has a value equivalent to voltage $V_2$–voltage $V_1$, voltages $V_1$ and $V_2$ being those illustrated in FIG. 8.

A Miller integrator composed of the pull-up FET Q1, the capacitor C1 and the current limiting component R1 is formed in the pulse generating circuit U1, enabling a waveform with a gently-sloping rise time to be formed.

FIG. 12B shows the elements generated by the pulse generating circuit U1 to form the first pulse.

As shown in FIG. 12B, when a pulse signal $V_{Hin1}$ is input into terminal $H_{in}$ and a pulse signal $V_{Lin1}$ having a reverse polarity into terminal $L_{in}$ of the IC1, the push-pull circuit is driven under the control of the IC1, outputting a first pulse from an output terminal $OUT_1$. The first pulse is a gently-sloping ramp pulse rising to the voltage $V_{set1}$.

Here, a gently-sloping rise time $t_1$ in the first pulse has the following relationship with a capacity $C_1$ of the capacitor C1, the voltage $V_{set1}$, a potential difference VH between terminals Ha and Vs in the IC1, and a resistance value $R_1$ of the current limiting component R1.

$$t_1 = (C_1 \times V_{set1})/[(V_{set1} - VH)/R_1]$$
$$= C_1 \times R_1 \times V_{set1}/(V_{set1} - VH)$$

Accordingly, the rise time $t_1$ can be adjusted by changing the capacity C1 of capacitor C1 and the resistance $R_1$ of the current limiting component R1.

As shown in FIG. 13A, the pulse generating circuit U2 is a push-pull circuit connected to an IC2 (for example IR-2113 manufactured by International Recifier). The IC2 is a three-phase bridge driver and the push-pull circuit is composed of a pull-up FET Q3 and a pull-down FET Q4. A capacitor C2 is inserted between the gate and drain of the pull-up FET Q4, and a current limiting component R2 is inserted between a terminal $H_0$ of the IC2 and the gate of the pull-up FET Q4. A uniform voltage $V_{set2}$ is applied to the push-pull circuit. This voltage $V_{set2}$ has a value equivalent to voltage $V_1$ illustrated in FIG. 8.

A Miller integrator composed of the pull-up FET Q4, the capacitor C2 and the current control component R2 is formed in the pulse generating circuit U2, enabling a waveform with a gently-sloping rise time to be formed.

FIG. 13B shows the elements generated by the pulse generating circuit U2 to form the second pulse.

As shown in FIG. 13B, when a pulse signal $V_{Hin2}$ is input into terminal $H_{in}$ and a pulse signal $V_{Lin2}$ having a reverse polarity into terminal $L_{in}$ of the IC2, the push-pull circuit is driven under the control of the IC2, outputting a second pulse from an output terminal $OUT_2$. The second pulse is a gently-sloping ramp pulse rising to the voltage $V_{set2}$.

Here, a gently-sloping rise time $t_2$ in the second pulse has the following relationship with a capacity $C_2$ of the capacitor C2, the voltage $V_{set2}$, a potential VL of terminal $L_a$ in the IC2, and a resistance value $R_2$ of the current limiting it component R2.

$$t_2 = (C_2 \times V_{set2})/[(V_{set2} - VL)/R_2]$$
$$= C_2 \times R_2 \times V_{set2}/(V_{set2} - VL)$$

Accordingly, the fall time $t_2$ can be adjusted by changing the capacity $C_2$ of capacitor C2 and the resistance $R_2$ of the current limiting component R2.

Requirements for Barrier Rib Height and Pitch

When the above set-up pulse waveform is used to drive a high-resolution PDP with a panel having around 1080 scan lines, the structural components of the panel should be designed as follows to achieve satisfactory driving of the PDP, in particular stable addressing.

The barrier ribs 30 should preferably have a height of between 80 μm to 110 μm.

This is because a height of no more than 110 μm enables addressing to take place stably even when the address pulse is no more than 1.5 μs, while a height of less than 80 μm would make the discharge space too narrow, increasing the likelihood of addressing instability.

When the barrier ribs 30 are from 80 μm to 110 μm high, stable addressing is ensured even if the address pulse is an extremely short one of around 1.25 μs.

An appropriate pitch for the barrier ribs 30 is between 100 μm and 200 μm (particularly between 140 μm and 200 μm).

This is because a pitch exceeding 200 μm means a larger panel and higher resistance values for each line of electrodes, making the achievement of a consistently high discharge difficult. Meanwhile, a pitch of less than 140 μm (particularly one of less than 100 μm) makes the discharge spaces narrower, and the address discharge is more erratic.

An appropriate range for the gap between each scan electrode line 12*a* and sustain electrode line 12*b* is between 50 μm and 90 μm.

This is because setting the gap at less than 50 μm makes the generation of short circuits during the production process more likely, while a gap exceeding 90 μm makes generation of discharge during high-speed driving more difficult.

The thickness of the part of the phosphor layer 31 on the substrate should preferably be set at a thickness of between 15 μm and 30 μm (particularly between 15 μm and 25 μm.)

The reason for this is that if the thickness of this part is less than 15 μm, the efficiency of the conversion of ultraviolet light to visible light is reduced, while if the thickness exceeds 25 μm (and even more so if it exceeds 30 μm) the discharge spaces become narrower, reducing the amount of ultraviolet light generated.

The width of each address electrode line 22 should preferably be between 40% and 60% of the pitch of the barrier ribs 30 (between 30% and 60% of the pitch is particularly desirable).

The reason for this is that a width of less than 40% of the pitch (particularly one of less than 30%) is too narrow, making stable address discharge more difficult to generate, while a width exceeding 60% of the pitch makes generation of crosstalk between neighboring cells more likely.

The dielectric layer 13 should preferably have a thickness of between 35 μm and 45 μm.

The reason for this is that if the dielectric layer 13 has a thickness of less than 35 μm, electric charge tends to dissipate, making unstable addressing more likely. Meanwhile, a thickness exceeding 45 μm increases the drive voltage.

The dielectric layer 23 should preferably have a thickness of between 5 μm and 15 μm (between 5 μm and 10 μm is particularly desirable).

The reason for this is that if the dielectric layer 23 has a thickness of less than 5 μm, electric charge tends to dissipate, making unstable addressing more likely. Meanwhile, a thickness exceeding 10 μm, and particularly one exceeding 15 μm, increases the drive voltage.

Alternatives for the Embodiment

The present embodiment gave an example illustrated in FIG. 4, in which, during the set-up period, a pulse waveform with the characteristics described above is applied to the scan electrode group 12*a*, and no voltage is applied to the address electrode group 22 (the electric potential of the address electrodes 22 during the set-up period is 0), or to the sustain electrode group 12*b* during intervals $A_1$ to $A_5$. However, a similar effect may be obtained by using voltages that result in the potential difference between the scan electrode group 12*a* and the address electrode group 22, and the potential difference between the scan electrode group 12*a* and the sustain electrode group 12*b* having the same characteristics as the above waveform during the set-up period.

For example, the waveforms illustrated in FIG. 12B may be applied during the set-up period. That is, a ramp voltage pulse having a positive voltage value $V_1$ is applied to the scan electrode group 12*a*, while a ramp voltage pulse having a negative voltage value $(V_1-V_2)$ is applied simultaneously to the address electrode group 22. Here, the voltage values $V_1$ and $V_2$ possess the same meaning as in the embodiment. The potential difference waveform applied between the scan electrode 12*a* and the sustain electrode group 22 has the same characteristics as the waveform shown in FIG. 8, and so similar effects are obtained.

Figure 14:
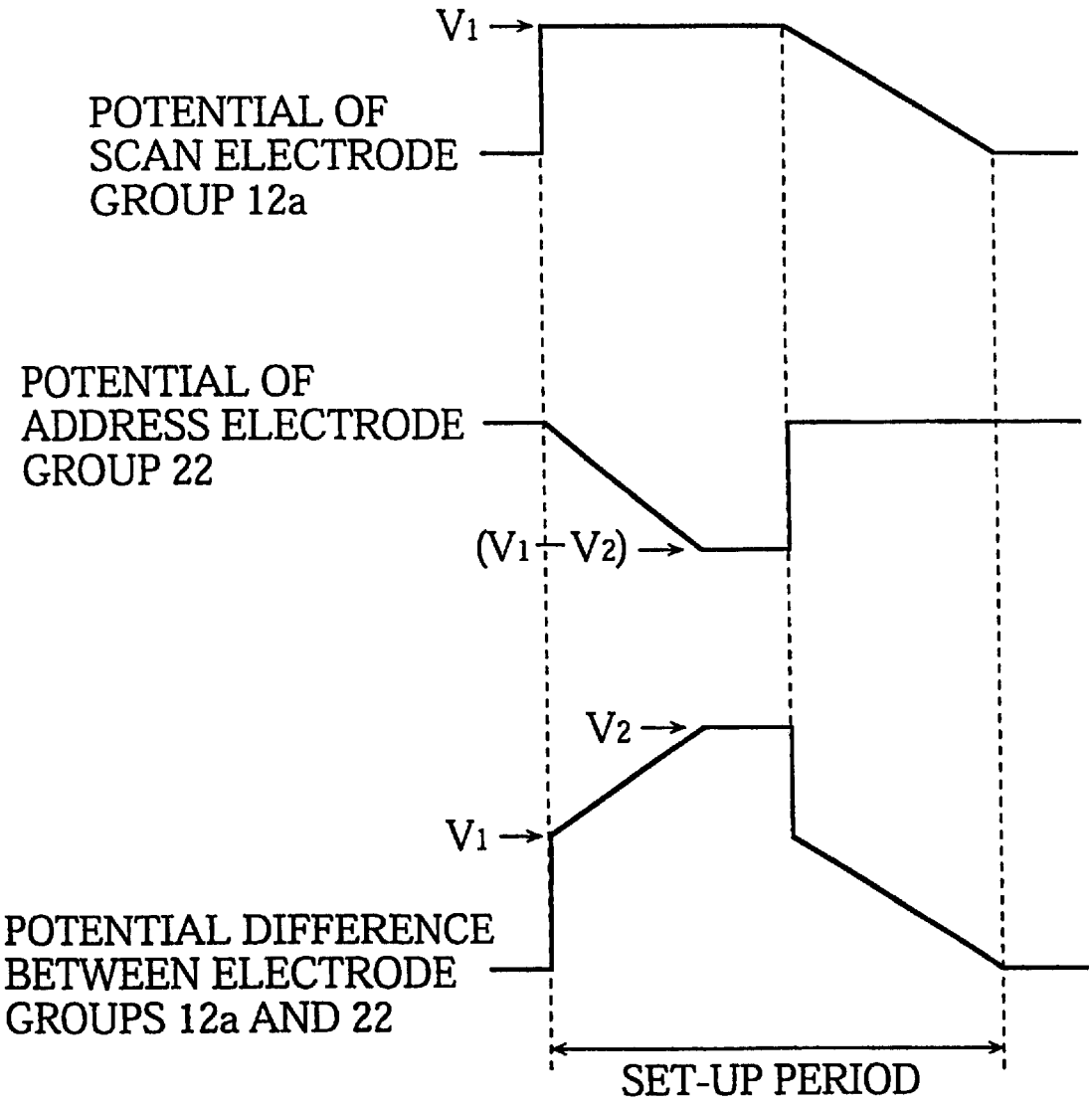
FIG. 14 shows waveforms applied during set up period.

Furthermore, the present embodiment showed an example in which the potential difference waveforms applied during the set-up period between the scan electrode group 12*a* and the address electrode group 22, and between the scan electrode group 12*a* and the sustain electrode group 12*b* both have characteristics like those illustrated in FIG. 8. However, if only the potential difference waveform applied to the scan electrode group 12*a* and the address electrode group 22 during the set-up period is like that in FIG. 8 and FIG. 14, a voltage waveform having characteristics similar to those of this voltage waveform will be applied to each cell, allowing almost the same effects to be obtained.

For example, if a voltage waveform having the same characteristics as the one in FIG. 8 is applied to both scan electrode group 12*a* and sustain electrode group 12*b*, a set-up discharge can be still be generated between the scan electrode group 12*a* and the address electrode group 22 and between the sustain electrode group 12*b* and the address electrode group 22. This enables almost identical effects to be obtained.

The present invention is not limited to use when driving the type of PDP described in the embodiment, and can be widely utilized in gas discharge panel display apparatuses driven by the ADS sub-field drive method. Provided that a voltage waveform having the same characteristics as in FIG. 8 is applied in each discharge cell during the set-up period, when a gas discharge panel is driven using the set-up period—address period—discharge sustain period sequence, the same effects can be obtained as in the embodiment.

EXAMPLE EMBODIMENT

TABLE 1

| SAMPLE No. | NUMBER OF SCAN LINES | ADDRESS METHOD | NUMBER OF SUB-FIELDS | MODE MAGNIFI-CATION | ADDRESS PULSE LENGTH (μsec) | SET-UP PULSE LENGTH (μsec) | SET-UP PERIOD (μsec) | ADDRESS PERIOD (μsec) | DISCHARGE SUSTAIN PERIOD (μsec) | REMAINING PERIOD (μsec) |
|---|---|---|---|---|---|---|---|---|---|---|
| 1 | 480 | SINGLE | 8 | 1 | 2.5 | 323.5 | 2788.0 | 9600.0 | 1275.0 | 3003.7 |
| 2 | 1080 | SINGLE | 8 | 1 | 2.5 | 360 | 3080.0 | 21600.0 | 510.0 | −8523.3 |
| 3 | 1080 | SINGLE | 8 | 1 | 1.5 | 360 | 3080.0 | 12960.0 | 510.0 | 116.7 |
| 4 | 1080 | SINGLE | 8 | 2 | 1.25 | 360 | 3080.0 | 10800.0 | 2550.0 | 236.7 |
| 5 | 540 | DUAL | 8 | 5 | 1.5 | 360 | 3080.0 | 6480.0 | 6375.0 | 731.7 |
| 6 | 540 | DUAL | 8 | 6 | 1.25 | 323.5 | 2788.0 | 5400.0 | 7650.0 | 828.7 |
| 7 | 540 | DUAL | 13 | 1 | 1.5 | 323.5 | 4530.0 | 10530.0 | 1275.0 | 331.2 |
| 8 | 540 | DUAL | 15 | 1 | 1.25 | 323.5 | 5227.5 | 10125.0 | 1275.0 | 39.2 |

TABLE 1-continued

| SAMPLE No. | NUMBER OF SCAN LINES | ADDRESS METHOD | NUMBER OF SUB-FIELDS | MODE MAGNIFI-CATION | ADDRESS PULSE LENGTH (μsec) | SET-UP PULSE LENGTH (μsec) | SET-UP PERIOD (μsec) | ADDRESS PERIOD (μsec) | DISCHARGE SUSTAIN PERIOD (μsec) | REMAINING PERIOD (μsec) |
|---|---|---|---|---|---|---|---|---|---|---|
| 9 | 540 | DUAL | 11 | 3 | 1.5 | 323.5 | 3833.5 | 8910.0 | 3825.0 | 98.2 |
| 10 | 540 | DUAL | 12 | 2 | 1.5 | 323.5 | 4182.0 | 9720.0 | 2550.0 | 214.7 |
| 11 | 540 | DUAL | 12 | 3 | 1.25 | 323.5 | 4182.0 | 8100.0 | 3825.0 | 559.7 |

Samples No. 1 to 11 (apart from sample No. 2) show the amount of time allotted to the 'discharge sustain period', and the 'remaining period', when the 'number of scan lines', 'address method', 'number of sub-fields', 'mode number', 'address pulse length', and 'set-up pulse length' in a PDP were set at various values.

The 'address method' column in Table 1 shows whether a single or dual scanning method is used. Samples 1 to 4 use a single scanning method and samples 5 to 11 a dual scanning method.

The 'number of scan lines' column shows the number of address pulses applied in one address period. The total number of scan lines in the panel of the PDP is 480 for sample 1, and 1080 for samples 2 to 10. However, samples 5 to 11 are driven using the dual scanning method, so the 'number of scan lines' column shows half of 1080, or 540, in this case.

The values in the 'set-up period (μs)' column show the total time occupied by the set-up period during one field (16.7 ms). Each value is obtained by multiplying the set-up pulse length by the number of sub-fields.

The values in the 'address period (μs)' column show the total time occupied by the address period during one field. Each value corresponds to the total of address pulse length× number of scan lines×number of sub-fields. However, the values for the address period in Table 1 also include the time taken to apply an erase pulse immediately following the application of the discharge sustain pulse.

The values in the 'discharge sustain period (μs)' column show the total time in each field allocated to the discharge sustain period.

The values in the 'remaining period (μs)' column are produced by subtracting the time taken by the set-up period, address period and discharge sustain period from the time for one field (16.7 ms).

Note that, in sample 2, the time taken by the address period is larger than the time for one field, so the remaining period is a negative value. Accordingly, driving could not actually take place under the conditions described in sample 2.

A PDP was driven and an image displayed under the conditions described in each of the samples in Table 1, except for sample 2. PDPs driven under the conditions of samples 3 to 11 displayed images satisfactorily.

Comparative Example

An example using a rectangular wave from the related art as the set-up pulse is described for the sake of comparison.

In this comparative example, the number of scan lines in the PDP is 480, the method used is dual scanning, the number of sub-fields in one field (16.7 ms) is twelve, and the total set-up period for each field is 4.54 ms.

Here, the address pulse has a length of 2.5 μs. In this case, the total address period for one field is 2.5 μs×12 (the number of sub-fields)×240 (lines)=7.2 ms.

This means that the discharge sustain period in one field is 3.825 ms, the same for sample 10 above, and the remaining period is 1135 μs.

When this alternative example is compared with sample 10, it can be seen that the proportion of time occupied by the discharge sustain period is the same in each case, but that the number of scan lines used in sample 10 is about twice as many, meaning that it has approximately double the resolution.

In other words, the present example shows that using the invention enables even a high-resolution PDP with a large number of scan lines to achieve the same luminance as a related art PDP with few scan lines.

This explanation has concentrated on the effects produced when the invention is applied to a PDP with a large number of scan lines. However, when the invention is applied to a PDP with a small panel and few scan lines, the discharge sustain period can be correspondingly lengthened. This results in such effects as an increase in panel luminance exceeding that of related art PDPs, and the ability to maintain sufficient panel luminance even if the single scanning method is used.

INDUSTRIAL APPLICABILITY

A PDP using the driving method and gas discharge panel display apparatus described in the present invention is effective in realizing display apparatuses for computers and televisions and in particular high-resolution large-screen devices.

What is claimed is:

1. A gas discharge panel display apparatus comprising a gas discharge panel and a drive circuit, the gas discharge panel including (1) first and second substrates placed in parallel opposition with a space in between, (2) first and second electrode groups, each formed from a plurality of electrode lines and covered with a dielectric layer, electrode lines from the first and second electrode groups being arranged alternately in parallel on a surface of the first substrate facing the second substrate, (3) a third electrode group, formed from a plurality of electrode lines and covered with a dielectric layer, arranged in parallel on a surface of the second substrate facing the first substrate in a direction at right angles to the first electrode group, the space between the substrates being divided by a barrier rib group, and a phosphorous material arranged between the barrier ribs, and the drive circuit including (a) a set-up unit for performing set-up by applying a voltage between the first electrode group and the third electrode group, (b) an address unit for writing an image by applying a voltage to electrode lines selected from the third electrode group, while applying a voltage sequentially to each of the electrode lines in the first electrode group, and (c) a discharge sustain unit for sustaining a discharge by applying a voltage between the first electrode group and the second electrode group, and then erasing a wall charge remaining inside discharge cells, wherein a waveform for the voltage applied between the first electrode group and the third electrode group by the set-up unit includes, in the following order:

a first interval in which the voltage rises to a first voltage, where 100 V≦first voltage<discharge starting voltage;

a second interval in which the voltage rises from the first voltage to a second voltage no less than the discharge starting voltage, a gradient of the voltage rise being smaller than a gradient of the voltage rise in the first interval;

a third interval in which the voltage falls from the second voltage to a third voltage lower than the discharge starting voltage; and a fourth interval in which the voltage falls still further from the third voltage, a gradient of the voltage fall being smaller than a gradient of the voltage fall in the third interval.

2. The gas discharge panel display apparatus of claim 1, wherein a space between an electrode line in the first electrode group and an electrode line in the second electrode group is 50 μm to 90 μm.

3. The gas discharge panel display apparatus of claim 2, wherein, in the voltage waveform applied by the set-up unit:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

4. The gas discharge panel display apparatus of claim 1, wherein the electrode lines in at least one of the first and second electrode groups are constructed by laminating a transparent electrically-conductive film and a non-transparent electrically-conductive film together.

5. The gas discharge panel display apparatus of claim 4, wherein, in the voltage waveform applied by the set-up unit:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

6. The gas discharge panel display apparatus of claim 1, wherein the barrier rib group is composed of a plurality of barrier ribs arranged at an even pitch, and each electrode line in the third electrode group is arranged in a space between neighboring barrier ribs, and has a width of between 30% to 60% of the rib pitch.

7. The gas discharge panel display apparatus of claim 6, wherein, in the voltage waveform applied by the set-up unit:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

8. The gas discharge panel display apparatus of claim 1, wherein the electrode lines in the first and second electrode groups are covered with a dielectric layer that is 20 μm to 45 μm thick.

9. The gas discharge panel display apparatus of claim 8, wherein, in the voltage waveform applied by the set-up unit:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

10. The gas discharge panel display apparatus of claim 1, wherein the electrode lines in the third electrode group are covered with a dielectric layer that is 5 μm to 15 μm thick.

11. The gas discharge panel display apparatus of claim 10, wherein, in the voltage waveform applied by the set-up unit:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

12. The gas discharge panel display apparatus of claim 1, wherein, in the voltage waveform applied by the set-up unit:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

13. The gas discharge panel display apparatus of claim 12, wherein each voltage pulse applied by the address unit is no longer than 1.5 μs.

14. The gas discharge panel display apparatus of claim 12, wherein the barrier rib group is no higher than 110 μm.

15. The gas discharge panel display apparatus of claim 14, wherein the barrier rib group is at least 80 μm high.

16. The gas discharge panel display apparatus of claim 15, wherein the barrier rib group is arranged in stripes having a rib pitch of no more than 200 μm.

17. The gas discharge panel display apparatus of claim 16, wherein the rib pitch of the barrier rib group is no less than 100 μm.

18. The gas discharge panel display apparatus of claim 16, wherein the rib pitch of the barrier rib group is no less than 140 μm.

19. The gas discharge panel display apparatus of claim 12, wherein at least one part of the phosphorous material is arranged as a phosphor layer on the surface of the second substrate facing the first substrate, the phosphor layer being between 15 μm and 30 μm thick.

20. A gas discharge panel drive method, for displaying an image on a gas discharge panel that includes (1) first and second substrates placed in parallel opposition with a space in between, (2) first and second electrode groups, each formed from a plurality of electrode lines and covered with a dielectric layer, electrode lines from the first and second electrode groups being arranged alternately in parallel on a surface of the first substrate facing the second substrate, (3) a third electrode group, formed from a plurality of electrode lines and covered with a dielectric layer, arranged in parallel on a surface of the second substrate facing the first substrate in a direction at right angles to the first electrode group, the space between the substrates being divided by a barrier rib group, and a phosphorous material arranged between the barrier ribs, and the gas discharge panel drive method including (1) a set-up step for performing set-up by applying a voltage between the first electrode group and the second electrode group, (2) an address step for writing an image by applying a voltage to electrode lines selected from the third electrode group, while applying a voltage sequentially to each of the electrode lines in the first electrode group, and (3) a discharge sustain step for sustaining a discharge by applying a voltage between the first electrode group and the second electrode group, and then erasing a wall charge remaining inside discharge cells, images being displayed by performing the above sequence of steps repeatedly, wherein a waveform for the voltage applied between the first electrode group and the third electrode group in the set-up step includes, in the following order:

a first interval in which the voltage rises to a first voltage, where 100 V≦first voltage discharge starting voltage;

a second interval in which the voltage rises from the first voltage to a second voltage no less than the discharge starting voltage, a gradient of the voltage rise being smaller than a gradient of the voltage rise in the first interval;

a third interval in which the voltage falls from the second voltage to a third voltage lower than the discharge starting voltage; and a fourth interval in which the voltage falls still further from the third voltage, a gradient of the voltage fall being smaller than a gradient of the voltage fall in the third interval.

21. The gas discharge panel drive method of claim 20, wherein, in the voltage waveform applied in the set-up step:

the absolute gradient of the voltage rise in the second interval and the absolute gradient of the voltage fall in the fourth interval are both no more than 9 V/μs;

the first interval and the third interval are both no more than 10 μs;

the fourth interval is between 100 μs and 250 μs; and the total time from the first to the fourth interval is no more than 360 μs.

22. The gas discharge panel drive method of claim 21, wherein each voltage pulse applied in the address step is no longer than 1.5 μs.

* * * * *